US005587049A

United States Patent [19]

Marzolini et al.

[11] Patent Number: 5,587,049

[45] Date of Patent: Dec. 24, 1996

[54] PROCESS FOR DELIGNIFYING RAW CELLULOSIC MATERIAL IMPREGNATED WITH MONOPERSULPHURIC ACID

[75] Inventors: Fausto Marzolini; Giulio Calmanti, both of Milan; Gianpiero Sacchi, Trivolzio, all of Italy

[73] Assignee: Ausimont S.p.A., Italy

[21] Appl. No.: 225,353

[22] Filed: Apr. 8, 1994

Related U.S. Application Data

[63] Continuation of Ser. No. 9,719, Jan. 27, 1993, abandoned.

[30] Foreign Application Priority Data

Jan. 31, 1992 [IT] Italy ..... MI92A0192

[51] Int. Cl.[6] ..... D21C 3/04; D21C 3/26

[52] U.S. Cl. ..... 162/40; 162/78; 162/82; 162/86; 162/90

[58] Field of Search ..... 162/76, 78, 90, 162/60, 19, 18, 40, 41, 82, 86

[56] References Cited

U.S. PATENT DOCUMENTS

| | | | |
|---|---|---|---|
| 4,404,061 | 9/1983 | Cael | 162/76 |
| 4,552,616 | 11/1985 | Kauppi | 162/19 |
| 5,004,523 | 4/1991 | Springer et al. | 162/76 |
| 5,089,086 | 2/1992 | Silander | 162/19 |
| 5,091,054 | 2/1992 | Meier et al. | 162/76 |
| 5,118,389 | 6/1992 | Dubelsten et al. | 162/19 |

FOREIGN PATENT DOCUMENTS 0415149 3/1991 European Pat. Off. .

OTHER PUBLICATIONS

Van Lierop, B., et al., "Caustic Extraction, Part I: Reaction Variables", *Bleaching, A TAPPI Press Anthology of Published Papers 1987–1990,* pp. 293–299 (Jameel, H., Ed. 1991).

Minor, J. L., et al., "Delignification of Woods Fibers with Peroxymonosulfate", Paperi ja Puu–Paper and Timber 72(10):967–973 (1990).

Rydholm, *Pulping Processes*, , Interscience Publishers, New York, Sep. 1967, pp. 294 and 354.

*Primary Examiner*—Steven Alvo

*Attorney, Agent, or Firm*—Bryan Cave LLP

[57] ABSTRACT

A process for delignifying raw cellulose which comprises a preliminary treatment for impregnating raw cellulose with a monopersulphuric acid solution, a successive filtration without washing with recycle of the filtered liquid to the first step, and a treatment, at low temperature and in alkaline solution at a pH higher than 9, of the previously impregnated raw cellulose in order to permit the reaction of the monopersulphuric acid with the lignin contained in the raw cellulose.

6 Claims, No Drawings

PROCESS FOR DELIGNIFYING RAW CELLULOSIC MATERIAL IMPREGNATED WITH MONOPERSULPHURIC ACID

This is a continuation of U.S. application Ser. No. 08/009,719, filed Jan. 27, 1993, now abandoned.

The present invention relates to a process for delignifying raw cellulose. By "raw cellulose" it is meant the product deriving from the so-called "cooking" of crushed wood in aqueous suspension in an autoclave at high temperature (160°–170° C.) in the presence of various chemical agents, for example sodium sulphate ("kraft" process), sodium bisulphite, sodium hydroxide, etc.

During the chemical treatment, lignin is partially removed from the wood fibers (reduction usually ranging from 80% to 90%); the raw cellulose still contains from 2 to 10% by weight of lignin depending on both the different starting wood types and the different cooking treatments. Further chemical treatments such as delignification and bleaching are therefore required in order to remove the residual lignin from raw cellulose and to improve the whiteness degree.

The conventional delignification and bleaching treatments comprise the use of gaseous chlorine, followed by a neutralization/extraction with caustic soda, by a further bleaching treatment with hydrogen peroxide, caustic soda and silicates and by a final bleaching with a hypochlorite solution. At present, due to environmental reasons, there is a tendency to substitute other oxidants for chlorine.

The present invention relates in particular to a delignification of raw cellulose by using monopersulphuric acid (hereinafter referred to as AMP) or salts thereof.

Processes which utilize AMP or its derivatives in the treatment of lignin-cellulosic materials are known from U.S. Pat. Nos. 4,404,061 and 5,004,523 and patent application EP-A-415,149.

U.S. Pat. No. 4,404,061 describes a process for bleaching wood pulp, wherein the wood pulp is brought into contact with $KHSO_5$ (0.5–5% referred to dry cellulose) at a pH ranging from 2 to 12 and at a temperature higher than 40° C. Such process, although it permits good results to be obtained in terms of whiteness, causes an undesirable degradation of cellulose, which adversely affects its mechanical characteristics.

U.S. Pat. No. 5,004,523 relates to a process for delignifying crumbled wood or similar cellulosic materials having a high lignin content, wherein the treatment with AMP is carried out in the acid range (pH=0–1.8) and at a temperature of about 50° C. This process is substantially a "cooking" process alternative to the classic processes, which permits to raw cellulose to be obtained having a low lignin content. The AMP consumption is rather high and ranges from 33% to 71% of the original AMP amount. Such a high AMP consumption is probably attributable to the presence, in the raw wood, of AMP decomposition "catalysts".

Patent application EP-A-415,149 describes a process for bleaching and delignifying cellulose materials, which comprises two consecutive steps, which include a washing: The first step consists in treating the cellulose material with AMP at pH values ranging from 1.9 to 9.3, while the second step consists in a treatment at 100° C. with gaseous oxygen and/or peroxides. The pretreatment with AMP or salts thereof would allow to a considerable increase in the oxygen selectivity in the oxidation step.

It is an object of the present invention to provide a process for delignifying lignin-cellulosic materials, which is based on the treatment with monoperoxysulphuric acid and which, besides involving a lower consumption of reagents in comparison with the known processes (in particular a lower AMP consumption), permits the obtaining of excellent mechanical properties of the delignified cellulose, particularly as regards the tearing properties of the delignified cellulose.

According to the present invention, such object is achieved in that the process comprises a preliminary step of impregnating the raw cellulose with an acid aqueous solution of monopersulphuric acid or its salts, and a step wherein the impregnated cellulose is treated in an alkaline medium at a pH higher than 9, at a temperature lower than 40° C. and for a time sufficient to obtain a substantial reduction of the lignin amount in the cellulose. The reaction between monopersulphuric acid and lignin, which leads to the delignification of the raw pulp, occurs in the alkaline step, while in the acid impregnation step the monopersulphuric acid remains stable and does not react with the lignin contained in the raw pulp.

Thanks to said characteristics it is possible to obtain a cellulose pulp which, after optional beating, gives a product exhibiting excellent mechanical properties and a tearing value (measured according to UNI/ISO standards) higher than 110 for the not beaten pulp, and higher than 65 for the beaten pulp. Such excellent results are due both to the particular pH values in the two consecutive steps of acid treatment and alkaline treatment (the latter being preferably carried out with NaOH), and to the low temperature maintained in both steps. In fact, it has been ascertained that, contrary to what is suggested by the art and in particular by U.S. Pat. No. 5,004,523, the best conditions for a chemical digestion of lignin by the monopersulphuric acid contemplate pH values higher than 9 and preferably ranging from 9.5 to 12.5. Thus, the preliminary acid step of the process, carried out by adding to the cellulose suspension a solution of monopersulphuric acid (preferably about 34% by weight) of sulphuric acid (preferably about 43% by weight) and of hydrogen peroxide (preferably about 4,5% by weight), has the function of dosing the monopersulphuric acid by correctly impregnating the fibers and of preparing the lignin for the subsequent digestion of cellulose by the monopersulphuric acid, without degrading the cellulose and hemicelluloses contained in the pulp and without requiring a high monopersulphuric acid consumption.

Preferably the process comprises between the two cellulose treating steps, i.e. the acid step and the alkaline step, a separation of cellulose from the acid solution, without any intermediate washing, in order to obtain a concentrated pulp of impregnated cellulose containing from 5 to 30% of dry matter, and a recycle of the solution obtained from said separation to the starting mixing step; The recycle is possible because AMP is stable in the acid step and does not react with the mixture components. In this manner, the monopersulphuric acid consumption is further reduced and limited to the amount of persulphuric acid solution which impregnates the thickened cellulose pulp.

Thanks to the filtration prior to the treatment with NaOH and to the recycling of the AMP solution—after having refilled the monopersulphuric acid amount retained by the cellulose—it is possible to obtain better mechanical characteristics of the treated cellulose as well as an economy in the consumption of reagents.

Preferably the solution utilized in the starting mixing of raw cellulose contains from 0.3 to 14% by weight, more preferably from 1.3 to 4% by weight (calculated on dry cellulose) of monopersulphuric acid and from 0.4 to 18%, more preferably from 1.7 to 5% by weight of sulphuric acid, such mixing being effected at a temperature preferably lower than 20° C. and for a time ranging from 5 to 90 minutes.

The monopersulphuric acid is preferably prepared by reacting $H_2SO_4$ at 96% with $H_2O_2$ at 60% in a molar ratio between the reagents ranging from 2:1 to 1:1, at a temperature below 20° C. Instead of monopersulphuric acid it is possible, of course, to use its salts in ranges of equivalent molar concentrations.

Preferably, the NaOH concentration utilized in the delignification treatment ranges from 1.5 to 26%, more preferably from 3 to 8% by weight calculated on dry cellulose and the corresponding treatment time ranges from 5 to 180 minutes.

Further advantages and characteristics of the process of the present invention will be apparent from the following examples.

EXAMPLE 1

A chemical cellulose pulp (obtained from spruce wood by means of a treatment with Ca bisulphite) at 2% of dry matter and containing 100 g of dry cellulose was additioned with 65.32 g of a solution deriving from the mixing of sulphuric acid at 96% and of hydrogen peroxide at 60% (molar ratio=1.75:1). The suspension was homogenized for 45 minutes and the measured pH value was 1.2.

The cellulose pulp was filtered up to 10% of dry matter, and the AMP content in the thickened cellulose pulp was equal to 4.08% by weight on dry cellulose. The solution resulting from the filtration was recycled to the starting mixing step, the correct AMP amount being restored by a new addition.

The concentrated cellulose pulp was treated with a NaOH amount equal to 8.3% on dry cellulose, at a pH of about 10.5–11.5. The reaction was exothermic and the temperature of the mass rose from the starting 16° C. to 23° C. On conclusion of the treatment with NaOH, which lasted about 90 minutes, the pH was about 9.5–10.

The characteristics of the treated cellulose indicated in Table 1 were determined.

For comparative purposes, the characteristics of the raw cellulose (without delignification/bleaching treatment) and of the cellulose treated according to a conventional delignification treatment based on the following steps: treatment with 3% of gaseous chlorine and neutralization with 1% of NaOH, were evaluated.

The values of a comparison among the various not beaten celluloses are reported in the following Table 1.

TABLE 1

| | Raw cellulose | Conventionally treated cellulose ($Cl_2$ + NaOH) | Treatment of the invention (AMP + NaOH) |
|---|---|---|---|
| Opacity | 90 | 8.5 | 83.1 |
| Whiteness | 55 | 50 | 67.2 |
| K | 14.7 | 6 | 5.8 |
| Ligning % | 2.2 | 0.9 | 0.88 |

From the above Table it is apparent that the treatment according to the present invention (AMP+NaOH) obtains a delignification degree equal to the one obtainable by means of the conventional treatment based on $Cl_2$+NaOH.

Furthermore, evaluations were made of the cellulose delignified and bleached with $H_2O_2$ according to the following modalities. After the treatment step with AMP+NaOH, the cellulose was washed with water and was concentrated up to about 11% of dry matter, and then it was subjected to a bleaching treatment with 1.5% of $H_2O_2$ (+1.6% of NaOH and 0.6% of sodium silicate—percentages referred to dry cellulose). In this step, the temperature was about 70°–75° C. and the reaction time was 75 minutes. The resulting cellulose was then subjected to a beating treatment (the beating degree was measured according to the S.R. methodology—standards UNI 7621). The results are expressed in the following Table 2.

TABLE 2

| | Conventional process | Process of the invention |
|---|---|---|
| Beating degree (S.R.) | 27 | 20 |
| Breaking length (m) | 6784 | 6457 |
| Tearing | 46 | 69 |
| Müllen index | 33 | 38 |
| Opacity | 68 | 80 |
| Whiteness | 85 | 84.8 |

From this Table is evident the increase (50%) in the tearing value, as well as in the opacity value.

Both for table 1 and for table 2 as well as for the subsequent tables, which are integrant part of the present invention, the following definitions are valid:

Breaking length (expressed in meters) according to standards UNI 6438;

Tearing (expressed in [$MN/m^2$]/g), measured according to standards UNI 6444;

Bursting index (or Müllen): bursting strength referred to weight (measured in [$kg/cm^2$]/[$g/m^2$]) according to standards UNI 6443;

Opacity (in %), measured according to standards UNI 7624;

Whiteness degree, or briefly "whiteness" (expressed in %), measured according to standards UNI 7623;

K: permanganate number, determined according to standards T 236 m/60 (indicative of the lignin amount contained in the cellulose ).

EXAMPLES 2–6

Following the procedure of example 1, the same type of chemical cellulose pulp was treated with different AMP concentrations in the thickened cellulose pulp (on dry cellulose) and, respectively, with different NaOH amounts (always calculated on dry cellulose). The results of examples 2–5 according to the invention (in terms of cellulose characteristics), as well as of comparative example 6 (relating to a treatment in which cellulose underwent a preliminary treatment with AMP, a washing and a successive treatment with caustic soda), are reported in the attached Table 3. From an examination of said table it is evident that also at low AMP concentrations it is possible to obtain a significant delignification of raw lignin.

EXAMPLES 7–10

In order to point out the criticality of the various operative parameters of the delignification process according to the invention, several tests were carried out starting from the raw cellulose utilized in example 1. In order to be able to examine the variations of the final characteristics of the cellulose, only one parameter at a time was varied. For delignification treatments without bleaching with $H_2O_2$ and without acid solution recycling (and therefore without filtration/concentration of the cellulose pulp between the two acid/alkaline steps), the results indicated in the attached Table 4 were obtained; for said table, the following definitions are valid:

A: % of cellulose in the suspension (consistency)
AMP: % of monopersulphuric acid (on dry cellulose)
T: treatment time (in minutes)
°b: whiteness degree
Op.: opacity
LR: breaking length (m)
LZ: tearing
M: Müllen index From a comparison of examples 7 and 8 with each other, which were effected varying the pH in the alkaline step, it is evident that at pH values ranging from 10 to 11 it is possible to obtain better results in terms of tearing resistance of the cellulose and slight increases in whiteness degree and breaking length, with respect to the values found in the cellulose obtained from treatments at higher pH values. From a comparative examination of examples 9 and 10 it results that the variation of the concentration (from 5.6% to 9.4%) of monopersulphuric acid in the acid and alkaline steps does not substantially modify the cellulose characteristics. An increase in the cellulose treatment time in the alkaline step (comparison between examples 9 and 8) results in an improvement of the mechanical characteristics of cellulose as well as its whiteness; that is due to a complete reaction between AMP and lignin.

EXAMPLES 11–14

Tests with cellulose filtration between acid step and alkaline step with recycle of the separate acid solution were carried out. The results are reported in Table 5, in which A indicates the consistency of the suspension in the acid step (% on dry basis of the suspension) and B indicates the consistency after thickening (filtration). The other references have the same meaning as the ones indicated in Table 4.

From an examination of the results of examples 11 and 12 it is evident that a temperature rise in the alkaline step corresponds to a worsening of the cellulose mechanical properties accompanied by a slight improvement of the whiteness degree. Actually, one of the most novel characteristics of the process of the invention is the treatment, at low temperature and in alkaline medium, of the cellulose which had been previously impregnated with AMP.

From a comparison of examples 13 and 14 the effect of the AMP concentration increase in the acid step is evident; this increase (at low temperature) corresponds to a higher whiteness degree as well as better tearing characteristics.

From a comparison of example 8 (Table 4) with example 13 of Table 5 it can be seen that—the other conditions being equal—the method of treating, in the alkaline step, a cellulose concentrated pulp (after filtration) offers the advantage of improving both the whiteness degree and the tearing characteristics of cellulose.

Delignification tests were carried out in an industrial plant having a capacity of 120 tons/day of paper. The results confirmed the values obtained in the laboratory.

TABLE 3

| Example | AMP % (1) | $H_2SO_4$ % (1) | NaOH % (1) | Opacity | Whiteness | K | % Lignin |
|---|---|---|---|---|---|---|---|
| 2 | 0.34 | 0.43 | 1.80 | 89.0 | 58.0 | 7.3 | 1.095 |
| 3 | 1.02 | 1.29 | 2.60 | 87.0 | 61.4 | 6.9 | 1.035 |
| 4 | 1.70 | 2.15 | 4.00 | 86.0 | 64.1 | 6.5 | 0.975 |
| 5 | 2.72 | 3.44 | 6.10 | 85.0 | 66.1 | 6.1 | 0.915 |
| 6 | 1.70 | 2.15 | 0.50 | n.d. | 56 | 11.4 | 1.71 |

(1): on dry cellulose

TABLE 4

| | ACID STEP | | | | | ALKALINE STEP | | | | | CELLULOSE CHARACTERISTICS | | | | | |
|---|---|---|---|---|---|---|---|---|---|---|---|---|---|---|---|---|
| Ex. | A | AMP | pH | t° (°C.) | T | AMP | pH starting | pH final | t° (°C.) | T | K | °b | Op. | LR | LZ | M |
| 7 | 3% | 9.11 | 1.25 | 18 | 45 | 9.11 | 13.3 | 13.2 | 30 | 80 | 6.3 | 71.6 | 79.5 | 4038 | 68.3 | 22.7 |
| 8 | 3% | 9.11 | 1.25 | 18 | 45 | 9.11 | 11.3 | 10.3 | 30 | 80 | 6.3 | 73 | 80.6 | 4531 | 84.2 | 24.7 |
| 9 | 3% | 9.11 | 1.25 | 18 | 45 | 9.11 | 11.3 | 10.5 | 30 | 25 | 9.0 | 62.0 | 89.8 | 6191 | 74.8 | 35.9 |
| 10 | 3% | 5.43 | 1.4 | 18 | 45 | 5.43 | 11.3 | 10.6 | 30 | 25 | 9.9 | 61.5 | 83.6 | 6337 | 75 | 37.3 |

TABLE 5

| | ACID STEP | | | | | ALKALINE STEP | | | | | | CELLULOSE CHARACTERISTICS | | | | | |
|---|---|---|---|---|---|---|---|---|---|---|---|---|---|---|---|---|---|
| Ex. | A | AMP | pH | t° (°C.) | T | B | AMP | pH start. | pH final | t° (°C.) | T | K | °b | Op. | LR | LZ | M |
| 11 | 3% | 18.8 | 0.85 | 18 | 45 | 6% | 9.11 | 11.5 | 10.8 | 24 | 45 | 6.5 | 70 | 85 | 4400 | 90 | 24 |
| 12 | 3% | 18.8 | 0.85 | 18 | 45 | 6% | 9.11 | 11.5 | 10.8 | 43 | 45 | 4.2 | 74 | 80 | 3800 | 75 | 19 |
| 13 | 3% | 37.6 | 0.6 | 18 | 45 | 12% | 9.11 | 11.5 | 9.6 | 27 | 80 | 6.3 | 75 | 80.9 | 4009 | 98.6 | 21 |
| 14 | 6% | 18.8 | 0.8 | 18 | 45 | 12% | 9.11 | 11.5 | 9.6 | 27 | 80 | 6.4 | 71 | 83.1 | 4100 | 92 | 23 |

We claim:

1. A process for delignifying raw lignocellulosic material comprising:

(1) a first step comprising:

(a) impregnating raw lignocellulosic material with an acid solution containing monopersulphuric acid or salts thereof in an amount ranging from 0.3 to 14% by weight of dry cellulose and sulphuric acid in an amount ranging from 0.4 to 18% by weight of dry cellulose, at a temperature lower than 20° C. and for a time ranging from 5 to 90 minutes to form impregnated lignocellulosic material;

(b) thickening the impregnated lignocellulosic material of step (1)(a) to obtain a concentrated pulp of impregnated lignocellulosic material containing from 5 to 30% of dry matter by separating the acid solution from the impregnated lignocellulosic material without any washing of the impregnated lignocellulosic material with water;

(c) recycling at least a portion of the solution obtained from the thickening of step (1)(b) to the acid solution of step (1)(a), and (2) conducting a second step prior to any washing of the impregnated lignocellulosic material of step (1) with water comprising:

treating the thickened, impregnated lignocellulosic material of step (1) with an alkaline medium at a pH higher than 9 to 12.5, at a temperature lower than 40° C., and for a time sufficient to obtain a substantial reduction in the amount of lignin contained in the thickened, impregnated lignocellulosic material.

2. The process of claim 1, wherein in the second step, the alkaline medium is a NaOH solution at a concentration ranging from 1.5 to 26% by weight based on the weight of the dry lignocellulosic material.

3. The process of claim 2, wherein the concentration of the NaOH solution in the second step ranges from 3 to 8% by weight on dry lignocellulosic material.

4. The process of claim 3, wherein the time sufficient to obtain a substantial reduction in the amount of lignin contained in the thickened, impregnated lignocellulosic material in the second step ranges from 5 to 180 minutes.

5. The process of claim 1, wherein the acid solution of step (1)(a) of the first step contains from 0.4 to 14% by weight, calculated on dry lignocellulosic material, of $H_2SO_4$.

6. The process according to claim 1, wherein the amount of monopersulphuric acid or salts thereof in the acid solution ranges from 1.3 to 4% by weight of dry lignocellulosic material and the amount of sulphuric acid in the acid solution ranges from 1.7 to 5% by weight of dry lignocellulosic material.

* * * * *